US005531300A

United States Patent [19]

Tsai

[11] Patent Number: 5,531,300

[45] Date of Patent: Jul. 2, 1996

[54] RETRACTABLE HANDLE ASSEMBLY FOR A SUITCASE

[76] Inventor: James Tsai, 103, Ta Ming 1 Rd., Tung Pao Tsun, Tan Tzu Hsiang, Taichung Hsien, Taiwan

[21] Appl. No.: 340,892

[22] Filed: Nov. 15, 1994

[51] Int. Cl.[6] ..... A45C 5/14; A45C 13/26

[52] U.S. Cl. ..... 190/115; 190/18 A; 190/39; 16/115

[58] Field of Search ..... 190/18 A, 39, 190/115, 117; 16/112, 115; 280/37, 655, 655.1, 47.315, 47.371

[56] References Cited

U.S. PATENT DOCUMENTS

| | | | |
|---|---|---|---|
| 2,437,029 | 3/1948 | Howard | 280/655 X |
| 3,178,197 | 4/1965 | Boatner | 280/37 |
| 5,178,244 | 1/1993 | Liang | 190/18 A |
| 5,197,579 | 3/1993 | Bieber et al. | 190/115 X |
| 5,253,739 | 10/1993 | King | 190/115 X |
| 5,294,145 | 3/1994 | Cheng | 280/655 X |
| 5,330,037 | 7/1994 | Wang | 190/18 A |
| 5,339,934 | 8/1994 | Liang | 190/115 X |
| 5,350,046 | 9/1994 | Falloon et al. | 190/115 |
| 5,360,222 | 11/1994 | Bro et al. | 280/47.371 X |
| 5,394,965 | 3/1995 | Kho | 190/18 A X |

FOREIGN PATENT DOCUMENTS

| | | | |
|---|---|---|---|
| 1098331 | 1/1968 | United Kingdom | 16/115 |

*Primary Examiner*—Sue A. Weaver
*Attorney, Agent, or Firm*—Bacon & Thomas

[57] ABSTRACT

A handle assembly for a suitcase wherein a retractable and extendable handle is secured to the suitcase through a positioning bracket that is provided with a pair of spring clips and a spring insert for automatically securing the handle in the retracted and extended positions.

2 Claims, 4 Drawing Sheets

RETRACTABLE HANDLE ASSEMBLY FOR A SUITCASE

BACKGROUND OF THE INVENTION

This invention relates to a suitcase and, more particularly, to a suitcase having a retractable handle which can be readily fully extended for pulling the suitcase when needed and fully retracted when not in use.

Travel is very popular and more and more people go abroad during holidays. As a result, the suitcase is an inevitable utility for a traveler. In fact, there are many foldable luggage carriers available for handling luggage. On the other hand, many suitcases are incorporated with a pair of rollers for easily moving the suitcase and a handle which can also be extended or retracted between different positions for pulling the suitcase. Usually, the handle of the suitcase is provided with an adjusting knob for actuating the handle. A suitcase of this type is disclosed in a patent granted to the applicant, wherein when the user desires to adjust the handle, the length of the handle must first be adjusted by operating the adjusting knob. When the length is set, the adjusting knob must then be locked for securing the handle in the desired length. When the handle is to be retracted, the user must conduct the reverse procedure. Though this mechanism is workable, it is not suitable for use during the rush hours or in a crowded bus or train. When the user is on an elevator, the situation becomes more inconvenient. Accordingly, there is a need to provide an improvement for this type of suitcase.

SUMMARY OF THE INVENTION

It is the object of this invention to provide a suitcase having a retractable handle which can be readily fully extended for pulling the suitcase when needed and the handle can be readily fully retracted when not required for use. According to one aspect of this invention, when the handle slides to the lower or retracted position, a spring clip of a positioning member engages a stopping post. On the other hand, when the handle slides to its upper or extended position, a spring is engaged within a recess of the handle to prevent the handle from loosening. According to another aspect of this invention, the handle can be readily attached to the suitcase by means of a positioning bracket. The positioning member is secured to the back of the positioning bracket and is slidably retained within a slide slot of the handle. By this simple and effective mechanism, mass production of the invention can be facilitated.

BRIEF DESCRIPTION OF THE DRAWINGS

The structural and operational characteristics of the present invention and its advantages as compared to the known state of the prior art will be better understood from the following detailed description, in conjunction with the attached drawings which show illustratively, but not restrictively, an example of a suitcase having a retractable handle assembly of the invention. In the drawings.

DETAILED DESCRIPTION OF THE PREFERRED EMBODIMENT

Figure 1:
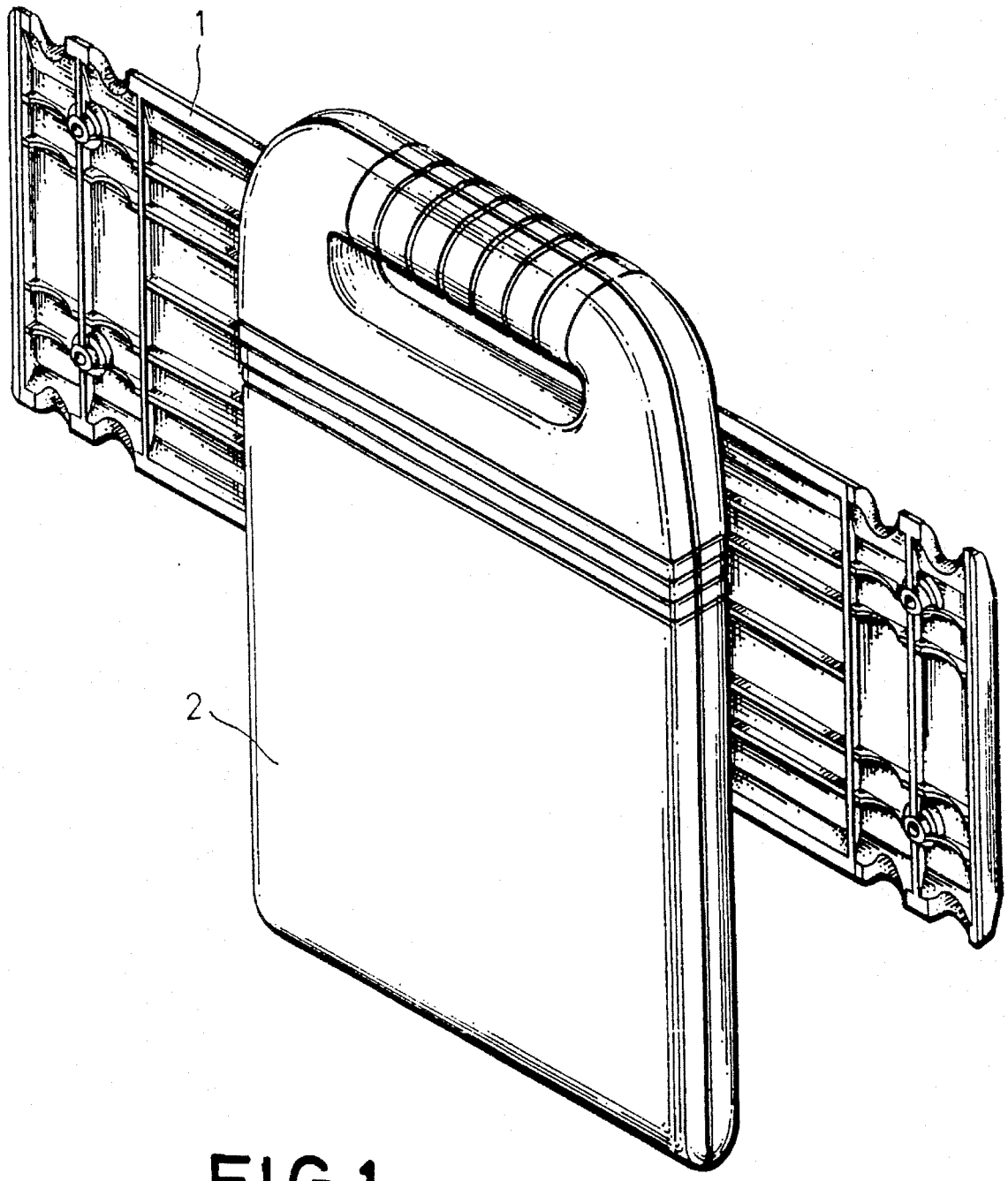
FIG. 1 is a perspective view of a handle assembly according to this invention.
Figure 2:
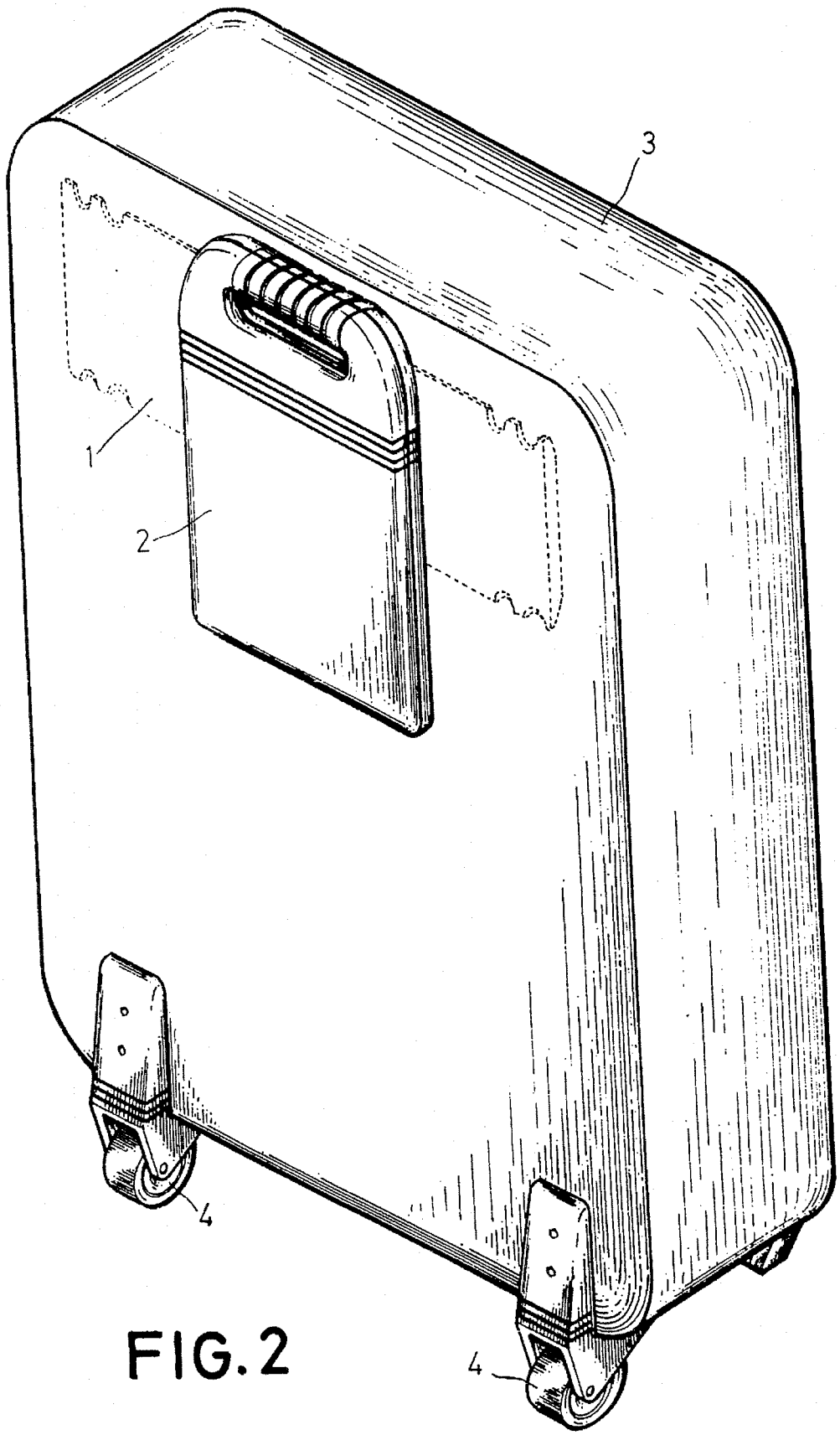
FIG. 2 is a perspective view of the handle assembly applied to a suitcase.

Referring to FIGS. 1 and 2, the handle assembly of the invention generally includes a positioning bracket 1 and a handle 2 for attachment to a suitcase 3. The suitcase 3 is provided with a pair of rollers 4 at its bottom. The suitcase 3 is also provided with the positioning bracket 1 at an upper position opposite to said roller 4 across one side of suitcase 3. A pair of positioning members 5 are secured to said positioning bracket 1 by screws 30 and each member 5 includes a rear block 50 which is received within a slide slot 7 and a spring clip 8 which is engaged within a slot rail 6 of handle 2. Each slot rail 6 includes a pair of opposed fastener holes 6A for securing rail 6 to a slide slot 7 of the handle 2. By this arrangement, handle 2 and rails 6 are slidable along the positioning members 5, the latter being engaged within the slide slots and rails 6, 7 and the handle 2 is thus capable of moving between a fully extended position and a fully retracted position.

Figure 3:
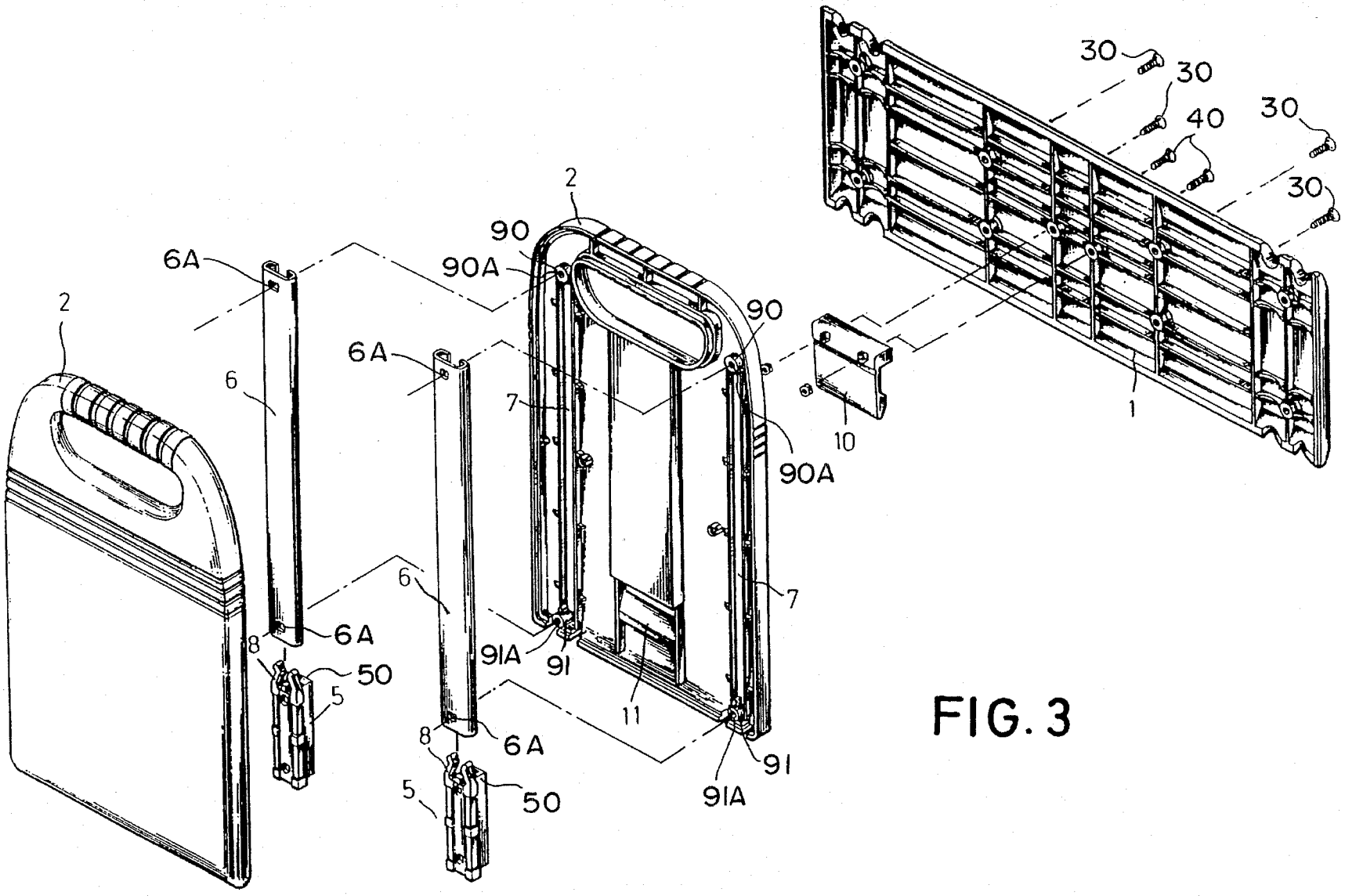
FIG. 3 is an exploded perspective view of the handle assembly according to this invention.
Figure 4A:
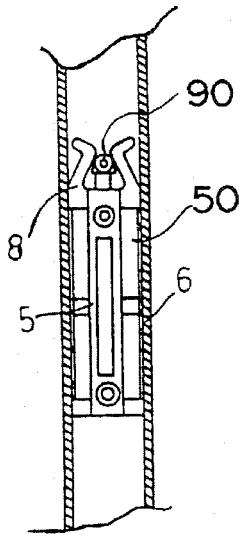
FIGS. 4A and 4B are partial rear views of the handle assembly showing the spring clip engaged within a slot rail and, respectively, engaged with and disengaged from a stopping post.

As seen in FIG. 3, each slide slot 7 is provided with an upper stopping post 90 having a fastener hole 90A and a lower stopping post 91 having a fastener hole 91A. Holes 90A and 91A are aligned with holes 6A for receiving fasteners (not shown) which secure rails 6 to slide slots 7 of handle 2. When handle 2 is pushed into its retracted position, the upper portion of each spring clip 8 engages its corresponding upper stopping post 90, as seen in FIG. 4A, thereby securing handle 2 in its retracted position.

Figure 4B:
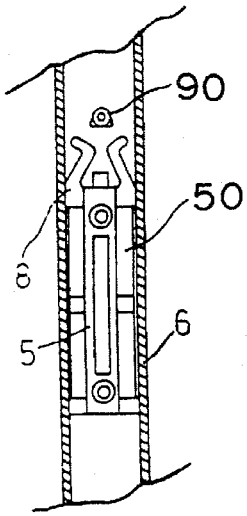
Figure 5A:
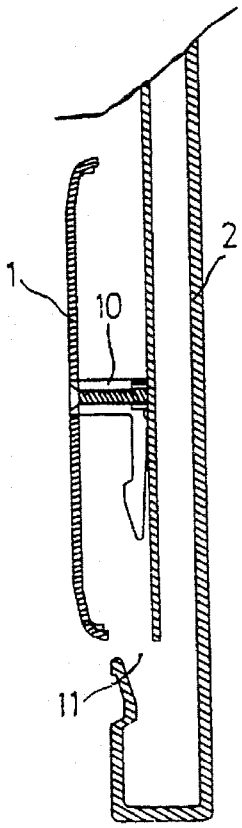
FIGS. 5A and 5B are partial side views showing the spring insert, respectively, disengaged from the engaged within a recess of the handle.
Figure 5B:
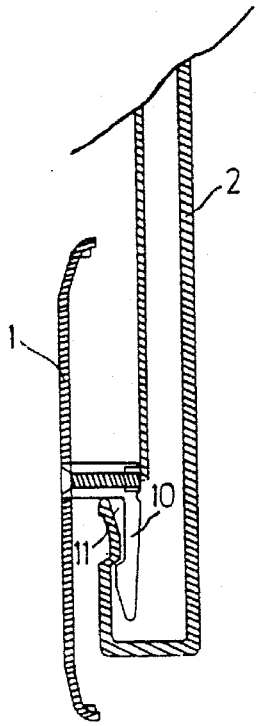

When handle 2 is being pulled outwardly to its extended position of use, spring clips 8 disengages from posts 90, as seen in FIG. 4B. Continued pulling of handle 2 eventually causes positioning members 5 to engage lower stopping posts 91, thereby terminating the outward extension of handle 2. At this point, a spring insert 10, secured to bracket 1 by screws 40, engages a recess 11 of handle 2. This engagement of insert 10, together with the engagement of blocks 50 within slots 7, serves to securely maintain handle 2 in its fully extended position.

As is apparent, handle 2 may be automatically secured in its retracted and extended positions by virtue of spring clips 8 and spring insert 10 by, respectively, pushing or pulling handle 2. Similarly, handle 2 may also be easily released from its retracted or extended positions by, respectively, pulling or pushing handle 2.

Although the present invention has been described in connection with the preferred embodiment thereof, many other variations and modifications will become apparent to those skilled in the art without departing from the spirit of the invention or scope of the subjoined claims.

I claim:

1. A retractable handle assembly for a suitcase comprising:

(a) a handle including at least one slide slot having an upper stopping post and a lower stopping post, at least one slide rail secured to the slide slot and a recess;

(b) a positioning bracket for attachment to a side of a suitcase opposite a pair of rollers at a bottom of the suitcase, the positioning bracket including a spring insert and at least one positioning member secured thereto;

(c) the positioning member including a spring clip positioned for slidably engaging with the slide rail and a block positioned for slidably engaging with the slide slot;

(d) the handle being slidable relative to the positioning bracket between a position of full retraction wherein the spring clip engages the upper stopping post for securing the handle in the position of full retraction and a position of full extension wherein the positioning member engages the lower stopping post for limiting the degree of full extension and the spring insert being positioned for engaging the recess of the handle and securing the handle in the position of full extension; and (e) wherein the handle is released from the position of full retraction by pulling same outwardly of the positioning bracket and released from the position of full extension by pushing the handle inwardly of the positioning bracket.

2. The retractable handle assembly of claim 1, wherein:

(a) the handle includes a pair of slide slots and a pair of slide rails; and (b) the positioning bracket includes a pair of positioning members secured thereto.

* * * * *